United States Patent [19]

Giampieri

[11] 4,212,936

[45] Jul. 15, 1980

[54] COLOR CONTRAST RADIOGRAPHIC FILM

[75] Inventor: Claudio Giampieri, Carcare, Italy

[73] Assignee: Minnesota Mining and Manufacturing Company, St. Paul, Minn.

[21] Appl. No.: 854,629

[22] Filed: Nov. 25, 1977

Related U.S. Application Data

[63] Continuation of Ser. No. 583,404, Jun. 3, 1975, abandoned.

[51] Int. Cl.[2] ..... G03C 1/76

[52] U.S. Cl. ..... 430/503; 430/139; 430/363; 430/504; 430/506; 430/508; 430/509; 430/967

[58] Field of Search ..... 96/74, 6, 7, 9, 22, 96/100 R, 82

[56] References Cited

U.S. PATENT DOCUMENTS

| | | | |
|---|---|---|---|
| 2,509,766 | 5/1950 | Gross | 96/22 |
| 2,688,539 | 9/1954 | Heimbach et al. | 96/9 |
| 2,994,610 | 8/1961 | Maus | 96/100 |
| 3,637,388 | 1/1972 | Rauz et al. | 96/69 |
| 3,671,257 | 6/1972 | Otto et al. | 96/100 R |

FOREIGN PATENT DOCUMENTS

| | | | |
|---|---|---|---|
| 1286831 | 8/1972 | United Kingdom | 96/74 |

*Primary Examiner*—Travis J. Brown

*Attorney, Agent, or Firm*—Cruzan Alexander; Donald M. Sell; Mark A. Litman

[57] ABSTRACT

A photographic element having at least two silver halide emulsion layers, one layer containing a colorless cyan-forming coupler which produces a negative image and the other layer containing a colored coupler which upon color development with a p-phenylene diamine developer produces a positive dye image of contrasting color to cyan, will produce a color contrast radiographic picture after exposure and development.

10 Claims, No Drawings

COLOR CONTRAST RADIOGRAPHIC FILM

This is a continuation of application Ser. No. 583,404, filed June 3, 1975, now abandoned.

It is normally accepted in the photographic art that a color contrast film is very desirable, especially in the specific area of radiography.

A color contrast film according to the present invention is capable of producing upon color development with p-phenylene diamine developers an image of the subject in two opposite scales of distinct colors, one negative and the other positive. Both colors are to be chosen to "create a contrast". Contrasting colors are those colors sufficiently distinct as to be able to define a distinct border to the eye when viewed next to each other. For example, the best contrasts are complementary colors such as blue and yellow or other specific combinations as blue or blue-green (cyan) and red or red-blue (magenta).

One of the recent inventions in this field has been described in Italian Pat. No. 974,830 of the same applicant. This system unfortunately displayed instability in the colloidal silver image.

Some prior art in this field includes U.S. Pat. Nos. 2,644,096; 2,593,925; 2,931,904; 2,807,725; 2,906,881; Allst German Pat. Nos. 970,220; 977,204; 1,011,277; 1,046,495; 1,076,490; 1,135,754; Allst German Offenlegungsschrift Nos. 1,946,652 and 2,045,399; French Pat. Nos. 1,056,200; 1,190,520; 1,283,925 and British Pat. No. 716,064.

In addition, British Pat. No. 1,286,831 describes a new method based on a material which includes (a) at least one colorless color coupler capable of forming an azomethine quinoneimine dyestuff by coupling with an oxidized aromatic amino developing agent and (b) at least one colorless compound which is capable of oxidative coupling with said colorless coupler to form a dye.

Other methods based on "masked" color couplers (couplers which have chromogenic groups as splitting-off substituents attached to reactive methylene are known. These masked couplers are colored before development and react with p-phenylene diamine developers to give a different color, as for example described in U.S. Pat. No. 2,449,966) have been tried, but as stated in British Pat. No. 1,286,831, the secondary or masking image formed in color masking is of very low density in relation to the main image and it would be incompatible with the object of color masking to make the secondary image otherwise than of such very low density.

Attempts to make color contrast radiographic based on a combination of colorless-masked couplers in a single layer, as normally known to the skilled in the art of the subtractive process, did not given good results. A sensitometric analysis on these methods cannot be made because it is not traditionally meaningful to analyze the involved sensitometric curves (one negative, the other positive). This is because of the interference due to the silver reduced upon color development (present in the final image in the form of a negative image) and because of secondary absorptions of the dyes formed by the couplers upon color development. It has been believed that the couplers interfere to negatively affect each other's reactivity, but the nature of this interference is not well understood. This is true, for example, when the couplers are introduced into the same negative emulsion layer by the dispersion technique. In dispersion techniques, the coupler molecules are present in the layer dissolved in water-immiscible organic solvents, dispersed in the layer itself in the form of very small droplets which should limit every competitive reaction between different species of couplers since dispersed separately (see infra U.S. Pat. No. 3,703,375 Table 1).

It has been found that very good results can be obtained with associating the colorless coupler to a negative silver halide layer and the colored masking coupler to another negative silver halide layer, said couplers being preferably dispersed in the layers dissolved in water immiscible organic solvents.

It has also been found that emulsions having more speed, that is grains bigger than those normally used in high-definition radiographic materials, do not affect the quality of the positive image when associated with the colored couplers which modulate said positive image.

It has been found that very good results are achieved when the emulsion associated with the colored coupler is more sensitive than that associated with the colorless coupler by at least 3 DIN at a density equal to 0.5 measured at a light of color complementary to the color formed upon color development of the colored coupler itself. For example, when an emulsion is associated with a colored coupler, e.g., a yellow-colored coupler forming a magenta dye, then the sensitivity is measured by exposing the emulsion layer coated on a base at a green light (i.e., the contrasting color to that formed by the dye), processing the exposed photographic element in a standard developing bath and fixer bath (comprising the color development bath and fixing bath of Example 11) and determining in logE (wherein E means light energy of exposure), from a sensitometric curve, the exposure necessary to get a density equal to 0.5; in the comparative sensitivity, every 0.1 logE of difference is assumed to correspond to one DIN of difference in sensitivity and thus it is clear that less exposure corresponds to higher speed.

The present invention thus refers to a photographic element for use in radiography which includes a base and at least two silver halide emulsion layers characterized by the fact that one of said layers is reactively associated with a colorless cyan forming coupler in a way as to give a negative colored image upon color development with p-phenylene-diamine developers and the other emulsion is associated with a colored coupler which constitutes the positive image whose color is chosen to provide the desired color contrast with the other dye (i.e. the cyan) which forms the negative image. This contrasting color coupler has a chromogenic group attached to the reactive methylene in the coupling position of the coupler, and the chromogenic group (the group which gives a color to the coupler) must be what is known in the art as a splitting-off group. That is, a group capable of being expelled from the coupling position during reaction with oxidized p-phenylene diamine developer without requiring any silver ion as oxidizing agent. These couplers must be therefore two-equivalent color couplers. Examples of these well-known splitting-off groups, and the preferred groups are arylazo, preferably phenyl or naphthylazo which may or may not be substituted with alkyl, alkoxy, halogen, cyano or nitro groups. As these two-equivalent couplers are well known in the art, further description is not believed necessary. This colored coupler with splitting-off link and chromogenic group, uniformly distributed in the layer before exposure and processing, is modulated (by destruction) upon color development with a p-phenylene diamine developer in the layer itself in the form of a positive image whose color is chosen to make a color contrast with the cyan color of the negative image and generates another colored dye in the form of a negative image whose color contributes to the positive-negative image contrast.

An example of this would be a colorless cyan coupler and a yellow colored, magenta forming coupler. The cyan is formed in one layer where coupling has taken place, and the yellow is destroyed (and magenta produced) in the other layer where coupling has taken place. Thus, a negative cyan positive yellow, and negative magenta image is formed. The contrast would be blue against yellow. This qualitative example describes one aspect of the invention.

The present invention refers to a photographic element as per above in which said colored coupler is a yellow colored coupler which upon color development with p-phenylene diamine developer forms a magenta dye in the form of negative image.

The present invention also refers to a photographic element having as a colored coupler a magenta (preferably a magenta-reddish) colored coupler which upon color development with p-phenylene diamine developers form a cyan dye in the form of a negative image.

The present invention refers to a photograhic element as per above characterized by having the emulsion layer associated with the colored coupler directly coated on the base and the emulsion associated with the colorless coupler coated thereon.

The present invention preferably refers to a photographic element as per above having coated on one side of the base a negative emulsion layer associated with a colored coupler and coated thereon an emulsion layer associated with the colorless cyan forming coupler and coated on the other side of the base a negative emulsion associated with the colorless cyan forming coupler.

The present invention also refers to a photographic element as per above having coated on each side of the base a silver halide emulsion layer associated with the colored coupler and coated thereon a silver halide emulsion layer associated with the colorless cyan forming coupler.

The present invention more preferably refers to a photographic element as per above having the silver halide emulsion associated with the colored coupler more sensitive than the silver halide emulsion associated with the colorless coupler of at least 3 DIN at a density equal to 0.5 measured at a light of color complementary to the color formed upon color development of the colored coupler itself as described before.

The present invention most preferably refers to a photographic element as per above having the silver halide emulsions associated with a green sensitizing dye in order to improve the sensitometric response of the photographic element.

The present invention further refers to a photographic element as per above including the couplers—colorless and colored ones—introduced therein by the dispersion technique.

The photographic element of the present invention may contain acutance dyes preferably associated with the emulsion layer directly coated on the base. The color of these dyes is preferably complementary to the color of the light emitted by an intensifying screen used for exposing the element itself as known to the art. Since the color of the light of preferred intensifying screens is generally blue or green, when used in combination with photographic elements including blue or green sensitizing dyes, a good acutance dye to be used within photographic elements according to preferred embodiments of the present invention would be a magenta colored dye.

The nature of the couplers to be used within the present invention depends upon the color contrast we want to get. For example, for having a good blue-yellow color contrast, a cyan colorless coupler can be used in combination with a yellow coupler which forms a magenta dye upon color development with p-phenylene diamine developers.

According to the substractive process for getting a color image, cyan is formed by the blue plus green, and magenta which is formed by blue plus red (equal to minus green). This means that the presence of a magenta dye in combination with a cyan dye makes the final image more blue, improving the color contrast of the image itself.

A color contrast cyan-magenta turned out to be better than a contrast blue-yellow because the magenta color proved to be less brilliant than the yellow color. This can be very good for the eyes of a radiologist who has to study the radiographs for long periods of time.

Additionally, because of its acutance dye function, the magenta dye distributed in the form of a uniform filter before exposure improved the definition of the final image itself, especially when exposed to green emitting screens.

Couplers which can be usefully embodied into photographic elements of the present invention include, for example, the following:

(C1)

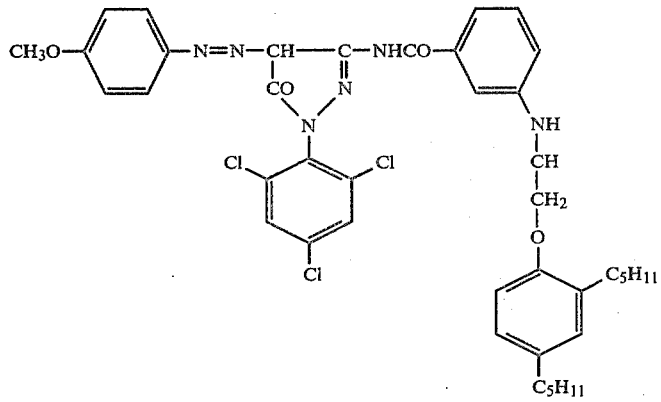

-continued (C2)

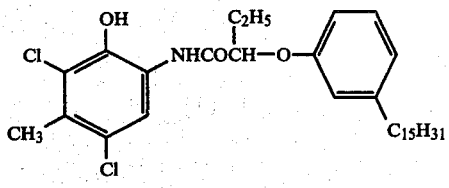

(C3)

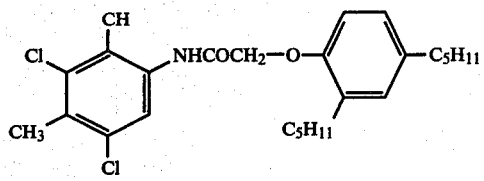

(C4)

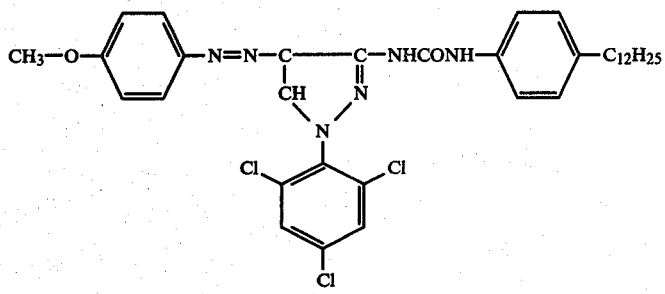

(C5)

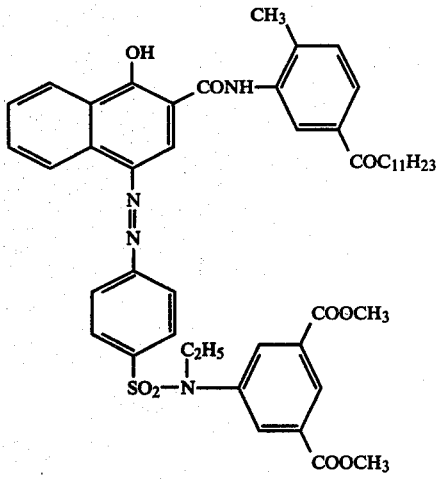

Couplers of this type have been described in U.S. Pat. Nos. 2,600,788; 2,367,531; 2,369,929; 2,423,730; IT Nos. 800,361; 876,084; 883,938.

One very good green sensitizing dye is the following one:

(S1)

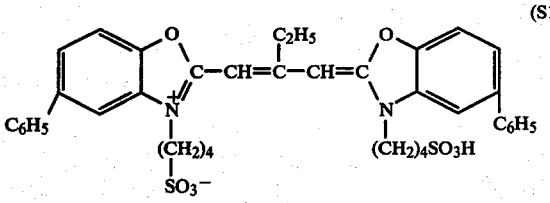

Sensitizing dyes of this type have been described in U.S. Pat. No. 2,503,776 and IT Nos. 493,530 and 520,746.

The couplers useful to the scope of the present invention are preferably introduced into the photographic elements of the present invention by the dispersion technique as described for instance in U.S. Pat. Nos. 2,322,027; 2,801,170; 2,801,171; 2,870,012 and 2,991,177.

Briefly, the solvent dispersion technique involves dissolving a coupler in a substantially water immiscible organic solvent and then dispersing the so-prepared solution as extremely fine droplets in a hydrophilic colloidal binder. Gelatin is the preferred colloidal binder, but other polymeric colloidal binder materials, known to the art, can also be utilized. Obviously, when the couplers are incorporated into the emulsion by the solvent dispersion technique, the dyes derived therefrom upon color development are also contained (dispersed) in the emulsion dissolved in the substantially water-immiscible organic solvent.

It is highly desirable that the couplers and the dyes derived therefrom upon color development be hydrophobic and non-diffusing in order to have the maximum definition quality. To this purpose, the couplers used in the present invention are provided with ballasting aliphatic chains having a total of at least ten carbon atoms.

The silver halide emulsions useful to the scope of the present invention are those normally known to those skilled in the art. Especially good are bromoiodide emulsions dispersed in gelatin or other equivalent hydrophilic colloidal binder, natural or synthetic, as for instance described in U.S. Pat. Nos. 2,286,215; 2,328,808; 2,322,085; 2,527,872; 2,541,474; 2,563,791; 2,768,154; 2,808,331; 2,852,382.

Said binder will preferably consist of gelatin possibly containing dispersed particles of hydrophobic polymer, such as for instance, polyethylacrylate, to improve the physical characteristics of the final layer.

The layers, thus obtained, can be hardened with hardeners known to those skilled in the art, such as for instance epoxides, formaldehyde, glyoxale, succinic, glutaric and resorcilic aldehyde, mucochloric and mucobromic acid, as described in U.S. Pat. No. 2,080,019, or mixtures thereof, as described for instance in U.S. Pat. No. 2,591,542.

The above emulsions can be chemically sensitized either by addition of sulfur compounds, as described for instance in U.S. Pat. Nos. 1,574,944; 1,623,469 and 2,410,689 and/or by addition of noble metals, such as rhutenium, rhodium, iridium, platinum and palladium; or by addition of Au salts, as described in U.S. Pat. No. 2,399,083. They also can be stabilized with Au salts, as described in U.S. Pat. Nos. 2,597,856 and 2,597,915.

The emulsions can contain organic stabilizers and antifoggants of the cyclic amine type, iminoazoles, such as mercaptobenzimidazole, triazoles, such as those described in U.S. Pat. No. 2,444,608; azaindenes, such as those described in U.S. Pat. Nos. 2,444,605; 2,444,606; 2,444,609; 2,450,397; 2,713,541; 2,716,062; 2,735,769; 2,743,181; 2,756,147; 2,772,164 and E. J. Birr in Z. Wiss. Phot. 472 (1952); tetrazoles, such as 1-phenyl-5-mercapto-tetrazole, thiazoles and benzothiazoles, such as 1-methyl-benzothiazole and benzothiazole quaternary salts, as described in U.S. Pat. No. 2,131,038; mercaptobenzothiazoles, such as 1-methylmercapto-benzothiazole; oxazoles; thiosemicarbazides; pyrimidines; iodonium derivatives; benzenesulfinic acids; inorganic stabilizers of the zinc and cadmium salt type, such as those described in U.S. Pat. No. 2,839,405.

The emulsion can further contain any suitable plasticizer, known to the man skilled in the art, such as glycerin or any surfactant which may be useful for coating the layers on the support base or on each other.

The photographic elements of the present invention are to be developed in p-phenylene diamine color development baths as normally in the art of color photography. Particularly good results, however, can be obtained by using developing baths as described in Italian Pat. No. 974,830, which include a p-phenylene diamine compound, alkali or ammonium thiosulfate and phenidone in an aqueous alkaline solution.

Examples of suitable p-phenylene diamine developers, which can be employed to develop photographic elements containing the couplers of the present invention, are the following developers and their salts such as the sulfites, the hydrochlorides and the sulfates of:

(a) N,N-diethyl-phenylene diamine;
(b) N-ethyl, N$\beta$-methanesulfonamido-ethyl-3-methyl-4-aminoaniline;
(c) N-ethyl, N-hydroxyethyl-2-methyl-p-phenylene diamine;
(d) N-ethyl, N-hydroxyethyl-p-phenylene diamine;
(e) N,N-diethyl-2-methyl-p-phenylene diamine.

The development step is generally followed by a fixing acid bath including thiosulfate ions which have the function of stopping the development and carrying away silver ions in non-exposure areas in the form of soluble silver-thiosulfate complexes. A washing step can follow as a stabilizing bath.

EXAMPLE 1

A color contrast X-ray film was prepared by coating on each side of a colorless polyester base two photosensitive layers and a protective layer following the sequence given below (corresponding to the following structure: p-c-m-b-m-c-p, wherein p=protective layer, c=cyan containing layer, m=magenta containing layer, b=base):

(m)—A gelatin silver halide photosensitive layer including a bromo-iodide emulsion (3% iodide), hardeners and stabilizers, having a silver coating weight of 0.5 g/m$^2$. The layer also contained 0.23 g/m$^2$ of yellow masked coupler C1 described before. (Such coupler was introduced into the layer by the solvent dispersion technique, according to the following method: 6 g. of the coupler were dissolved in 5 cc. of dibutylphthalate, 5 cc. of triphenylphosphate, and 16 cc. of ethyl acetate. This solution was then dispersed in 60 cc. of a 4% water solution of gelatin and 5 cc. of a 10% water solution of a surfactant agent).

(c)—A silver halide photosensitive layer consisting of a bromo-iodide emulsion (3% iodide) including hardeners and stabilizers, having a silver coating weight of 2.5 g/m$^2$. The layer contained also 3.15 g/m$^2$ of the coupler C2 described above. (Such coupler was introduced into the layer by the solvent dispersion technique, according to the following method: 10 g. of the coupler were dissolved in 1.25 cc. of dibutylphthalate, 1.25 cc. of dibutylformamide, 0.5 g. of surfactant and 10 cc. of ethyl acetate. This solution was then dispersed in 32 cc. of a 10% water solution of gelatin and 10 cc. of a 5% water solution of surfactant).

(p)—Protective layer of hardened gelatin having a gelatin coating weight of 1.10 g/m$^2$.

EXAMPLE 2

A color contrast X-ray film was coated as described in Example 1, with the difference that in this case the layers m) and c) were optically sensitized to the green region of the spectrum by adding the sensitizing dye S1 described above (about 100$\mu$moles dye per g-atom of silver).

EXAMPLE 3

A color contrast X-ray film was coated as described in Example 2. In this example, azogeranine as a magenta acutance dye was added to the layer m) in a quantity giving a density of about 0.10 when read with a green light on a Westrex Densitometer provided with a filter status A.

EXAMPLE 4

A color contrast X-ray film was prepared by coating on each side of a colorless polyester base two photosensitive layers and a protective layer in the following sequence;

(m)—A gelatin silver halide photosensitive layer including a bromo-iodide emulsion (2% iodide having a sensitivity 3DIN higher than the emulsion described in Example 1, measured as previously described), hardeners and stabilizers and a silver coating weight of 0.4 g/m$^2$. The layer contained also 0.23 g/m$^2$ of the yellow masked coupler C1. In addition, the layer also contained a magenta acutance dye as described in Example 3.

(c)—A layer as described in Example 1.

The above-described layers (m) and (c) were optically sensitized to the green region of the spectrum by adding sensitizing dye S1 as in previous Example 2.

(p)—A protective coating as in Example 1.

EXAMPLE 5

A color contrast X-ray material was coated as described in Example 4, with the difference that both layers (m) and (c) were prepared including photosensitive bromo-iodide high speed emulsions similar to that used for layer (m) of Example 4.

EXAMPLE 6

A color contrast X-ray film was coated according to the following scheme: p-m-c-b-c-m-p, wherein m was a photosensitive emulsion layer associated with yellow magenta forming coupler and green sensitizing dye as layer (m) of Example 2; (c) was photosensitive emulsion layer associated with colorless cyan forming coupler and green sensitizing dye as layer (c) of Example 2; (p) was the same protective layer of Example 1; and (b) was the same polyester base of Example 1.

EXAMPLE 7

A color contrast X-ray film coated according to the following scheme p-m-c-b-c-p, wherein m) was a photosensitive emulsion layer as described in Example 2, associated with 0.46 g/m$^2$ of the same yellow magenta forming coupler, and having a silver coating weight of 1.0 g/m$^2$ of silver. The silver halide grains were rendered green sensitive by means of the same green sensitizing dye described in Example 2; (c) was a photosensitive emulsion layer similar to layer (c) of Example 2; (p) was a protective layer as described in Example 1; and (b) was the same polyester base of Example 1.

EXAMPLE 8

A color contrast X-ray material was coated according to the following scheme: p-c-m-b-c'-p, wherein (m) was a photosensitive emulsion layer as described in Example 2, with a silver coating weight of 0.8 g/m$^2$ and a yellow masked coupler coating weight of 0.37 g/m$^2$; (c) was a photosensitive emulsion layer as described in Example 2, with a silver coating weight of 2.1 g/m$^2$ and a coupler coating weight of 2.65 g/m$^2$; (c') was a photosensitive emulsion layer as described in Example 2, with a silver coating weight of 2.9 g/m$^2$ and a coupler coating weight of 3.65 g/m$^2$; (p) was a protective layer as described in Example 1; and (b) was the base of Example 1.

EXAMPLE 9

A color contrast X-ray film was coated according to the following scheme: p-c-m-b-c'-p, wherein (m) was a photosensitive emulsion layer as described in Example 4 , with a silver coating weight of 0.8 g/m$^2$ and a yellow masked coupler coating weight of 0.46 g/m$^2$; (c) was a photosensitive emulsion layer as described in Example 2, with a silver coating weight of 1.7 g/m$^2$ and a coupler coating weight of 2.15 g/m$^2$; (c') was a photosensitive emulsion layer as described in Example 2, with a silver coating weight of 2.5 g/m$^2$ and a coupler coating weight of 3.15 g/m$^2$; (p) was a protective layer as described in Example 1; (b) was the base.

EXAMPLE 10

A color contrast X-ray film was coated according to the following scheme: p-c-m-b, wherein (m) was a photosensitive emulsion layer as described in Example 9; (c) was a photosensitive emulsion layer as described in Example 2, having a silver coating weight of 4.7 g/m$^2$ and a coupler coating weight of 5.9 g/m$^2$; (p) was a protective layer as described in Example 1; and (b) was the base.

The image quality and the sensitometric characteristics of the materials prepared according to Examples 1 to 10 were compared with those obtained with the materials prepared as described in the following examples outside the scope of the invention.

EXAMPLE A

A color contrast X-ray film was prepared by coating on each side of a colorless polyester base a photosensitive layer and a protective layer following the sequence given below (corresponding to the scheme p-m+c-b-m+c-p):

(m+c)—a silver halide photosensitive layer consisting of a bromo-iodide emulsion (3% iodide moles), including hardeners and stabilizers and having a silver coating weight of 3.0 g/m$^2$. The layer contained also 0.23 g/m$^2$ of a yellow masked coupler C1 and 3.2 g/m$^2$ of the cyan coupler C2. Such couplers were introduced by the solvent dispersion technique as respectively described in Example 1-m and 1-c. The layer was optically sensitized to the green region of the spectrum by adding the dye S1 (about 100 $\mu$M dye per g-atom of silver).

(p)—A protective layer as described in Example 1-p.

EXAMPLE B

A black and white 3 M X-ray film type R commonly available on the market.

EXAMPLE C

A color contrast X-ray film prepared according to Italian Pat. No. 974,830 of the same applicant. The materials described in Examples 1 to 10 and Examples A, B and C were exposed, in a first case, with two beams of blue light (one beam for each side), obtained by filtering a white light with a 39 Wratten and grey filter having an optical density of 0.40. In a second case, the same materials, with the exception of that described in Example B, were exposed with a beam of blue light (obtained as previously described) on one side, and with a beam of green light (obtained by filtering a white light with a 57 Wratten filter) on the other side.

Blue and blue-green lights obtained as said above are strictly comparable with the emissions of normally used $CaWO_4$ screen and of a Gadolinium Oxysulfide screen.

EXAMPLE 11

The materials of Examples 1 to 10, A and C were processed, after exposure, in a rapid automatic processor as described in Italian Pat. No. 965,804, with a total processing time of 138 seconds from dry to dry. The processing sequence is shown below:

(1) Color development bath working at 40° C. and having the following formula:

| | |
|---|---|
| Water | 800 cc. |
| Ethylene glycol | 3.5 cc. |
| Benzyl alcohol | 7.0 cc. |
| Hydroxylamine sulfate | 8.0 g. |
| Diethylenetriamine penta-acetic acid | 2.5 g. |
| Sodium sulfite, anydrous | 2.0 g. |
| Phenidone | 0.7 g. |

-continued

| | |
|---|---|
| N-ethyl-N-hydroxyethyl-p-phenylene diamine sulfate | 10 g. |
| Potassium hydroxide (35% solution) | 10 cc. |
| Potassium carbonate | 80 g. |
| Sodium bromide | 1 g. |
| 6-nitro-benzimidazole nitrate (1% solution) | 20 cc. |
| Sodium thiosulfate | 0.3 g. |
| Water to make | 1,000 cc. |
| pH at 20° C. | 10.70 ± 0.05 |

(2) Fixing bath having the following formula:

| | |
|---|---|
| Water | 800 cc. |
| Ammonium thiosulfate anhydrous | 150 g. |
| Sodium sulfite anhydrous | 19.5 g. |
| Sodium tetraborate crystals | 14.9 g. |
| Sodium acetate crystals | 3.5 g. |
| Acetic acid glacial | 17.1 g. |
| Aluminum sulfate | 8.98 g. |
| Sulfuric acid concentrate | 4.1 g. |
| Water to make | 1,000 cc. |
| pH at 20° C. | 4.05 |

(3) Final washing.

(4) Drying by means of a processor described in Italian Pat. No. 965,804 of the applicant.

The material described in Example B was processed in a process including a 3M XAD 90 rapid automatic developer with a total processing time of 90".

Sensitometric results were obtained and the most significant of these are given below in Tables 1 and 2.

TABLe 1

| | | | (blue light exposure) | | | | |
|---|---|---|---|---|---|---|---|
| Examples | Lights | Minimum Density | Speed (Δlog E) D.O.=1.0 | Low Contrast D.O.=030–0.90 | Medium Contrast 0.90–2.10 | High Contrast 2.10–3.10 | D max |
| 1 | Red Light (RL) | 0.25 | −1.82 | 1.22 | 4.25 | 6.40 | |
| | Blue Light (BL) | 1.12 | | | | | |
| | Visual Light (VL) | 0.19 | −1.58 | 1.33 | 2.24 | 1.56 | 3.65 |
| 2 | RL | 0.29 | −1.94 | 0.86 | 4.25 | 6.97 | |
| | BL | 1.15 | | | | | |
| | VL | 0.22 | −1.70 | 1.14 | 2.32 | 1.94 | 4.05 |
| 3 | RL | 0.24 | −1.89 | 1.22 | 4.51 | 6.76 | |
| | BL | 1.09 | | | | | |
| | VL | 0.19 | −1.67 | 1.34 | 2.32 | 2.06 | 4.05 |
| 4 | RL | 0.28 | −1.89 | 0.84 | 4.19 | 6.62 | |
| | BL | 0.89 | | | | | |
| | VL | 0.21 | −1.66 | 1.29 | 2.17 | 1.62 | 3.74 |
| 5 | RL | 0.44 | −2.18 | | 3.62 | 7.35 | |
| | BL | 0.86 | | | | | |
| | VL | 0.28 | −1.93 | 0.81 | 2.59 | 2.01 | 3.48 |
| 6 | RL | 0.25 | −1.82 | 1.22 | 4.25 | 6.40 | |
| | BL | 1.13 | | | | | |
| | VL | 0.19 | −1.58 | 1.33 | 2.24 | 1.56 | 3.65 |
| 7 | RL | 0.26 | −1.83 | 1.06 | 4.04 | 6.24 | |
| | BL | 1.07 | | | | | |
| | VL | 0.20 | −1.61 | 1.21 | 2.13 | 1.76 | 3.83 |
| 8 | RL | 0.28 | −1.85 | 0.77 | 4.15 | 6.58 | |
| | BL | 0.97 | | | | | |
| | VL | 0.21 | −1.60 | 1.17 | 2.15 | 1.60 | 3.71 |
| 9 | RL | 0.28 | −1.89 | 0.84 | 4.19 | 6.62 | |
| | BL | 0.89 | | | | | |
| | VL | 0.21 | −1.66 | 1.29 | 2.17 | 1.62 | 3.74 |
| 10 | RL | 0.24 | −1.77 | 1.03 | 3.46 | 5.12 | |
| | BL | 0.86 | | | | | |
| | VL | 0.20 | −1.48 | 1.06 | 1.38 | | 2.63 |
| A | RL | 0.23 | −1.56 | 1.17 | 3.97 | 6.21 | |
| | BL | 1.38 | | | | | |
| | VL | 0.19 | −1.31 | 1.21 | 2.20 | 2.01 | 3.88 |
| C | RL | 0.23 | −1.95 | 1.24 | 4.48 | 6.83 | |
| | BL | 0.68 | | | | | |
| | VL | 0.24 | −1.77 | 1.09 | 1.95 | 1.20 | 3.44 |
| B | Visual | 0.22 | −2.00 | 1.21 | 3.03 | 2.20 | 3.96 |

The materials described in Examples 1, 2, 4, A, B and C were radiographically exposed through standard blue emitting medium speed intensifying screens. All the exposed samples were processed in the rapid process described in Example 11. The materials of Examples 1, 2 and 4 exhibited a better definition over the materials of Examples A, B and C. Particularly, when compared to the material of Example A, said materials appeared to have greater speed and higher contrast of the yellow positive curve. This fact resulted also in pure colors and very pleasant images. This was emphasized with the material of Example 4, in which the yellow masked coupler was introduced in a silver halide emulsion of greater speed with respect to the emulsion used for the cyan forming layer.

TABLE 2

| | | | (blue-green light exposure) | | | | |
|---|---|---|---|---|---|---|---|
| Examples | Lights | Minimum Density | Speed (Δ log E) D.O.=1 0 | Low Contrast D.O.=030–0.90 | Medium Contrast 0.90–2.10 | High Contrast 2.10–3.10 | D max |
| 1 | Red Light (RL) | 0.24 | −1.86 | 1.26 | 4.39 | 6.97 | |
| | Blue Light (BL) | 1.13 | | | | | |

TABLE 2-continued

| Examples | Lights | Minimum Density | Speed (Δ log E) D.O.=1 0 | Low Contrast D.O.=030–0.90 | Medium Contrast 0.90–2.10 | High Contrast 2.10–3.10 | D max |
|---|---|---|---|---|---|---|---|
| | | (blue-green light exposure) | | | | | |
| | Visual Light (VL) | 0.18 | −1.63 | 1.34 | 2.26 | 1.68 | 3.72 |
| 2 | RL | 0.31 | −2.98 | | 4.94 | 8.57 | |
| | BL | 1.19 | | | | | |
| | VL | 0.23 | −2.80 | 1.41 | 2.80 | 2.50 | 4.57 |
| 3 | RL | 0.28 | −2.79 | 0.73 | 5.20 | 7.98 | |
| | BL | 1.12 | | | | | |
| | VL | 0.21 | −2.60 | 1.37 | 2.85 | 2.54 | 4.57 |
| 4 | RL | 0.29 | −2.74 | 1.01 | 4.98 | 7.80 | |
| | BL | 0.91 | | | | | |
| | VL | 0.21 | −2.55 | 1.40 | 2.59 | 1.91 | 4.07 |
| 5 | RL | 0.55 | −2.96 | | 3.96 | 7.78 | |
| | BL | 0.89 | | | | | |
| | VL | 0.33 | −2.74 | | 2.90 | 2.71 | 3.71 |
| 6 | RL | 0.27 | −2.67 | 1.03 | 4.66 | 7.88 | |
| | BL | 1.20 | | | | | |
| | VL | 0.20 | −2.47 | 1.38 | 2.64 | 2.05 | 4.26 |
| 7 | RL | 0.27 | −2.72 | 1.06 | 5.12 | 7.61 | |
| | BL | 1.18 | | | | | |
| | VL | 0.21 | −2.53 | 1.40 | 2.74 | 2.21 | 4.39 |
| 8 | RL | 0.29 | −2.66 | 0.80 | 4.93 | 7.67 | |
| | BL | 1.00 | | | | | |
| | VL | 0.21 | −2.46 | 1.42 | 2.54 | 1.82 | 4.18 |
| 9 | RL | 0.29 | −2.74 | 1.01 | 4.98 | 7.80 | |
| | BL | 0.91 | | | | | |
| | VL | 0.21 | −2.55 | 1.40 | 2.59 | 1.91 | 4.07 |
| 10 | RL | 0.26 | −2.61 | 1.14 | 4.11 | 5.89 | |
| | BL | 0.90 | | | | | |
| | VL | 0.22 | −2.39 | 1.20 | 1.61 | | 2.93 |
| A | RL | 0.26 | −2.89 | 1.40 | 5.19 | 8.48 | |
| | BL | 1.41 | | | | | |
| | VL | 0.20 | −2.67 | 1.47 | 2.92 | 2.62 | 4.59 |
| C | RL | 0.25 | −2.68 | 1.34 | 5.18 | 7.81 | |
| | BL | 0.69 | | | | | |
| | VL | 0.26 | −2.51 | 1.12 | 2.25 | 1.27 | 3.68 |

The materials of Examples 2, 3, 4 , A and C were radiographically exposed through green emitting intensifying screens. All the samples exposed were processed in the rapid process described in Example 11. As already happened in the case of blue emitting intensifying screen exposure, the materials 2, 3 and especially 4, showed more pleasant images and purer colors, due to higher speed and greater contrast of the yellow positive curve with respect to material A.

EXAMPLE 12

A color contrast X-ray film was coated according to the scheme given in Example 8 (p-c-m-b-c'-p), wherein (m) was a photosensitive emulsion layer as described in Example 2-m, with a silver coating weight of 0.8 g/m$^2$. The layer contained 0.47 g/m$^2$ of a magenta masked coupler, C5 described before. (Such coupler was introduced into the layer by the solvent dispersion technique as described in Example 1-m); (c) was a photosensitive emulsion layer as described in Example 8-c; (c') was a photosensitive emulsion layer as described in Example 8-c'; (p) was a protective layer as described in Example 1-p; (b) was a colorless polyester base.

EXAMPLE D

A color contrast X-ray film was coated as described in Example A, with the difference that in this case the layer (c) contained 0.43 g/m$^2$ of a magenta masked coupler (C5), instead of the yellow masked coupler C1.

The materials of Example 12 and Example D were radiographically exposed and processed as described in Example 11 to obtain the following results:

TABLE 3

| Examples | Lights | Minimum Density | Speed (Δ log E) D.O.=1.0 | Low Contrast D.O.=0.30–0.90 | Medium Contrast 0.90–2.10 | High Contrast 2.10–3.10 | D max |
|---|---|---|---|---|---|---|---|
| | | (blue light exposure) | | | | | |
| 12 | Red Light | 0.30 | −1.87 | 0.90 | 4.25 | 6.66 | |
| | Green Light | 0.87 | | | | | |
| | Visual Light | 0.39 | −1.63 | 1.30 | 3.45 | 1.60 | 3.61 |

TABLE 4

| Examples | Lights | Minimum Density | Speed (Δ log E) D.O.=1.0 | Low Contrast D.O.=0.39–0.90 | Medium Contrast 0.90–2.10 | High Contrast 2.10–3.10 | D max |
|---|---|---|---|---|---|---|---|
| | | (blue-green light exposure) | | | | | |
| 12 | Red Light | 0.22 | −2.62 | 1.47 | 4.72 | 7.04 | |
| | Green Light | 0.87 | | | | | |
| | Visual Light | 0.35 | −2.54 | 1.19 | 2.69 | 2.33 | 3.92 |

TABLE 4-continued

| Examples | Lights | Minimum Density | Speed (Δ log E) D.O.=1.0 | Low Contrast D.O.=0.39–0.90 | Medium Contrast 0.90–2.10 | High Contrast 2.10–3.10 | D max |
|---|---|---|---|---|---|---|---|
| | | (blue-green light exposure) | | | | | |
| D | Red Light | 0.20 | −2.25 | 1.87 | 4.46 | 7.05 | |
| | Green Light | 1.15 | | | | | |
| | Visual Light | 0.32 | −2.17 | 1.20 | 2.75 | 2.43 | 4.05 |

I claim:

1. A photographic element for use in radiography which includes a base and, on one side of said base, only two silver halide emulsion layers, said element characterized by the fact that (1) said two silver halide emulsion layers in the element may contain as couplers only colorless cyan forming couplers and yellow colored couplers;

(2) at least one of said emulsion layers is reactively associated with said colorless cyan forming coupler so as to give a negative colored cyan image upon color development with p-phenylene diamine, (3) the other of said emulsion layers is reactively associated with said yellow colored coupler so as to leave a yellow colored positive image and a magenta colored negative image upon color development with p-phenylene diamine.

2. The element of claim 1 wherein said two emulsion layers are sensitized with blue or green sensitizing dyes.

3. Photographic element of claim 1 characterized by having the emulsion layer associated with the colored coupler directly coated on the base and the emulsion associated with the colorless coupler coated thereon.

4. Photographic element of claim 1 characterized by having coated on the other side of the base an emulsion layer associated with a cyan forming colorless coupler.

5. Photographic element of claim 4 characterized by having coated between the base and the cyan-colorless-coupler-containing emulsion an emulsion layer associated with said yellow colored coupler.

6. Photographic element of claim 1 characterized by the fact that the sensitivity of the emulsion associated with the colored coupler is higher than the sensitivity of the emulsion associated with the colorless coupler by at least 3DIN.

7. Photographic element of claim 1 characterized by the fact that the cyan forming coupler is a phenolic or naphtholic coupler.

8. Photographic element of claim 1 characterized by the fact that the yellow colored magenta forming coupler is a pyrazolone coupler.

9. Photographic element of claim 1 characterized by having said colorless and colored couplers dispersed in their respective layers, said couplers being dissolved in water-immiscible organic solvents.

10. Photographic element of claim 1 characterized by the fact that both silver halide emulsion layers include a green sensitizing dye.

* * * * *